US006408141B1

(12) United States Patent
Tahara

(10) Patent No.: US 6,408,141 B1
(45) **Date of Patent: *Jun. 18, 2002**

(54) IMAGE FORMING APPARATUS HAVING A SYSTEM FOR DETERMINING THE STATUS OF A MOUNTABLE PRINTER PROCESSING CARTRIDGE

(75) Inventor: Motoaki Tahara, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/221,842

(22) Filed: Dec. 29, 1998

(30) Foreign Application Priority Data

Dec. 29, 1997 (JP) ..... 9-368891

(51) Int. Cl.[7] ..... G03G 15/00
(52) U.S. Cl. ..... 399/12; 399/24; 399/77
(58) Field of Search ..... 399/12, 24, 25, 399/27, 28, 29, 30, 77, 236, 258, 262

(56) References Cited

U.S. PATENT DOCUMENTS 4,961,088 A * 10/1990 Gilliland et al. ..... 399/25
4,994,853 A * 2/1991 Fukuchi et al. ..... 399/12
5,021,828 A * 6/1991 Yamaguchi et al. ..... 399/24
5,043,764 A * 8/1991 Arnold et al. ..... 399/12
5,132,729 A * 7/1992 Matsushita et al. ..... 399/24
5,138,344 A * 8/1992 Ujita ..... 346/140
5,218,409 A * 6/1993 Tanaka et al. ..... 399/12
5,557,379 A * 9/1996 Nakamura et al. ..... 399/236
5,710,956 A * 1/1998 Kurohata et al. ..... 399/24

FOREIGN PATENT DOCUMENTS

JP 9-197941 7/1997

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

Machine discrimination data stored in an information storage area of a memory in a body of an image formation apparatus is read, and data stored in a machine information storage area of a memory in a cartridge mounted in the image formation apparatus is read. If the data in the cartridge is not "0", it is judged whether or not the data in the body is identical with the data in the cartridge. If not identical, an error flag is set into "1", and it is considered that a mounting error occurs, and controlling to prohibit image formation is performed. On the other hand, if the data in the cartridge is "0", the mounted cartridge is considered as an unused cartridge, and the machine discrimination data of the body is stored in the mounted cartridge.

38 Claims, 10 Drawing Sheets

IMAGE FORMING APPARATUS HAVING A SYSTEM FOR DETERMINING THE STATUS OF A MOUNTABLE PRINTER PROCESSING CARTRIDGE

BACKGROUND OF THE INVENTION

1. Field of the Invention

The present invention relates to an image formation apparatus which performs image formation, with a cartridge mounted therein.

2. Related Background Art

Conventionally, it has been known a color image formation apparatus in which plural image stations respectively corresponding to plural toner colors are arranged side by side.

In such the color image formation apparatus, even if a density of one of plural kinds of toners changes, a tint of an image obtained after multitransfer is performed is remarkably different from that of an original image, so that color reproducibility deteriorates. Therefore, in order to prevent such inconvenience, it is necessary to always maintain the toner density at a constant level. For this reason, for example, a ratio of the toner to a carrier (i.e., magnetic substance) in a development unit is measured by a sensor, and an obtained value is controlled to be close to a target density value. In this case, such a sensor output value differs according to an individual difference of each sensor and an environment in which the apparatus is being placed. Thus, it is necessary to previously read the sensor density of each image station at a time when the apparatus is initially placed, and store the read density in a memory of a body of the apparatus as the target density value.

Since such the color image formation apparatus is expensive and also difficult to be adjusted, it has been expected in recent years to downsize the apparatus, decrease a cost by reducing the number of parts, and simplify the adjustment. As the apparatuses capable of meeting such expectation, there have been known a copy machine, a printer and a facsimile apparatus each containing, in the form of a cartridge, an image formation station into which a photosensitive drum and a development unit to form a latent image are integrated. Further, it has been proposed to provide a memory in the cartridge and thus previously store an appropriate image formation condition in this memory.

Although such the image formation apparatus containing the cartridge of the image formation station into which the photosensitive drum and the development unit to form the latent image are integrated has the merit that a user can easily exchange the cartridge, there is some fear that the user erroneously mounts the cartridge currently used for one apparatus in the other apparatus.

By such an erroneous operation, the target value for maintaining the constant density in the development unit of one cartridge is controlled based on a target value of the other cartridge, so that it becomes impossible to correctly control the toner density of the development unit, thereby occurring a problem that color reproducibility of an original image is deteriorated.

Further, in a case where data representing the appropriate image formation condition is separately stored in both the memory of the image formation apparatus and the memory of the cartridge, the correct image formation condition data can not be obtained if a different cartridge is mounted.

SUMMARY OF THE INVENTION

An object of the present invention is to provide an image formation apparatus and its control method which eliminated such drawbacks as described above.

Another object of the present invention is to provide a cartridge, an image formation apparatus and its control method in which the cartridge is caused not to be used in apparatuses other than the specific apparatus to prevent image formation in inappropriate image quality.

Still another object of the present invention is to provide a cartridge, an image formation apparatus and its control method in which the apparatus corresponds to the cartridge one-to-one to allow high-quality image formation.

Other objects of the present invention will become apparent from the following detailed description based on the accompanying drawings and the claims.

DETAILED DESCRIPTION OF PREFERRED EMBODIMENTS

Hereinafter, the embodiments of the present invention will be explained with reference to the attached drawings.

Figure 1:
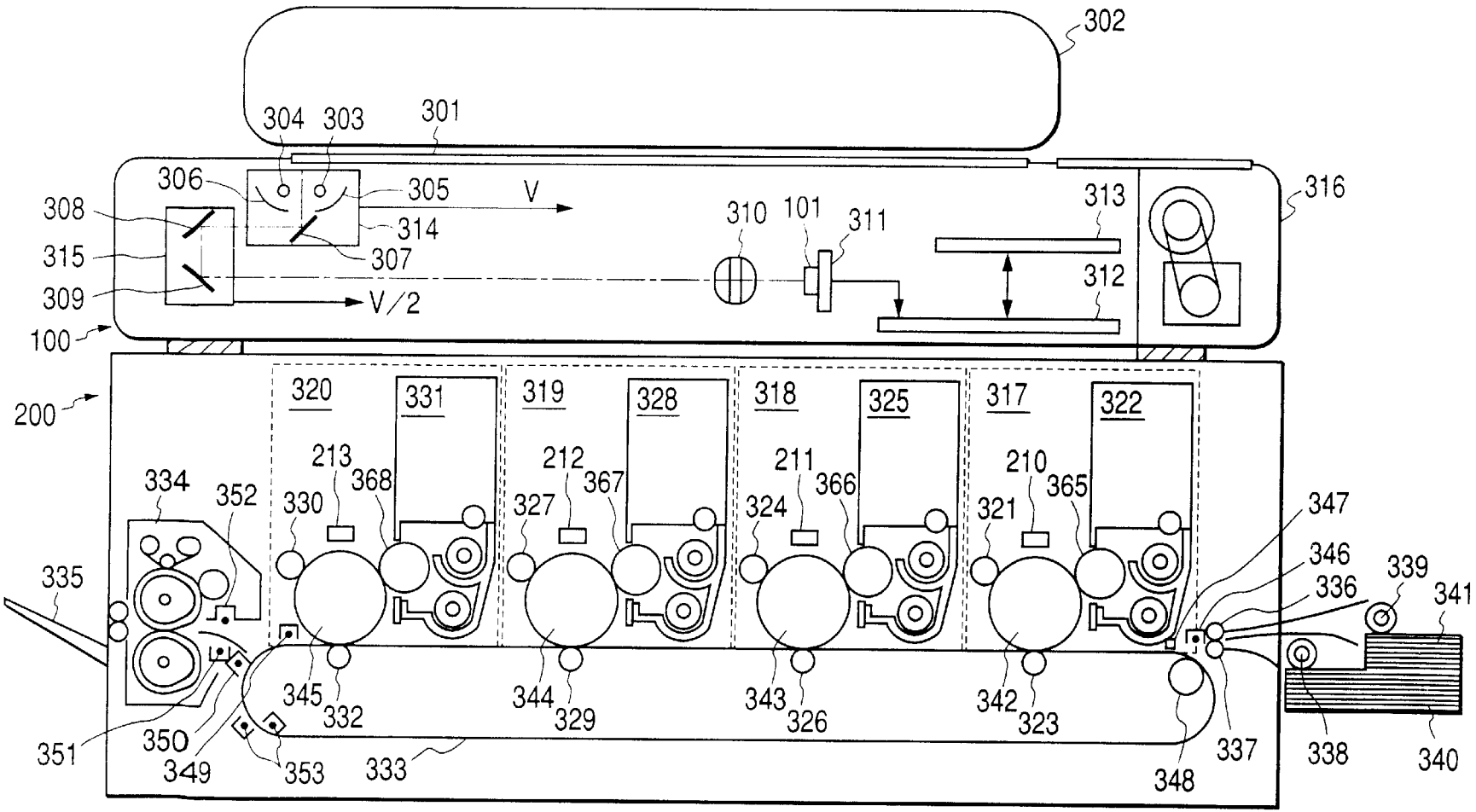
FIG. 1 is a schematic sectional view showing a color image process apparatus according to a first embodiment of the present invention.

FIG. 1 is a schematic sectional view showing a color image process apparatus according to the first embodiment of the present invention. The color image formation apparatus is composed of a color reader unit 100 and a color printer unit 200.

Initially, a structure of the color reader unit 100 will be explained.

In FIG. 1, numeral 101 denotes a CCD (charge coupled device), and numeral 311 denotes a substrate on which the CCD 101 is mounted. Numeral 312 denotes a digital image process unit containing an image process unit shown in FIG. 2 (except for CCD 101), and a binary conversion unit 201 and delay units 202 to 205 shown in FIG. 3. Numeral 301 denotes an original mounting glass (or platen glass), and numeral 302 denotes a document feeder (DF). In this case, it should be noted that a mirror-surface pressure board (not shown) may be used instead of the DF 302. Numerals 303 and 304 denote light sources (halogen lamp or fluorescent lamp) for illuminating an original, and numerals 305 and 306 denote reflectors for concentrating (or condensing) light from the light sources 303 and 304 onto the original. Numerals 307 to 309 denote mirrors, and numeral 310 denotes a lens for concentrating (or condensing) reflected or projected light from the original onto the CCD 101. Numeral 314 denotes a carriage holding therein the halogen lamps 303 and 304, the reflectors 305 and 306 and the mirror 307. Numeral 315 denotes a carriage holding therein the mirrors 308 and 309.

Numeral 313 denotes an interface (I/F) unit for interfacing an another image formation apparatus or the like. The carriage 314 mechanically moves at speed V in a direction perpendicular to an electrical-scan direction (main-scan direction) of the CCD 101, and also the carriage 315 mechanically moves at speed V/2 in the same direction. Thus, an entire face of the original is optically scanned (in sub-scan direction).

Figure 2:
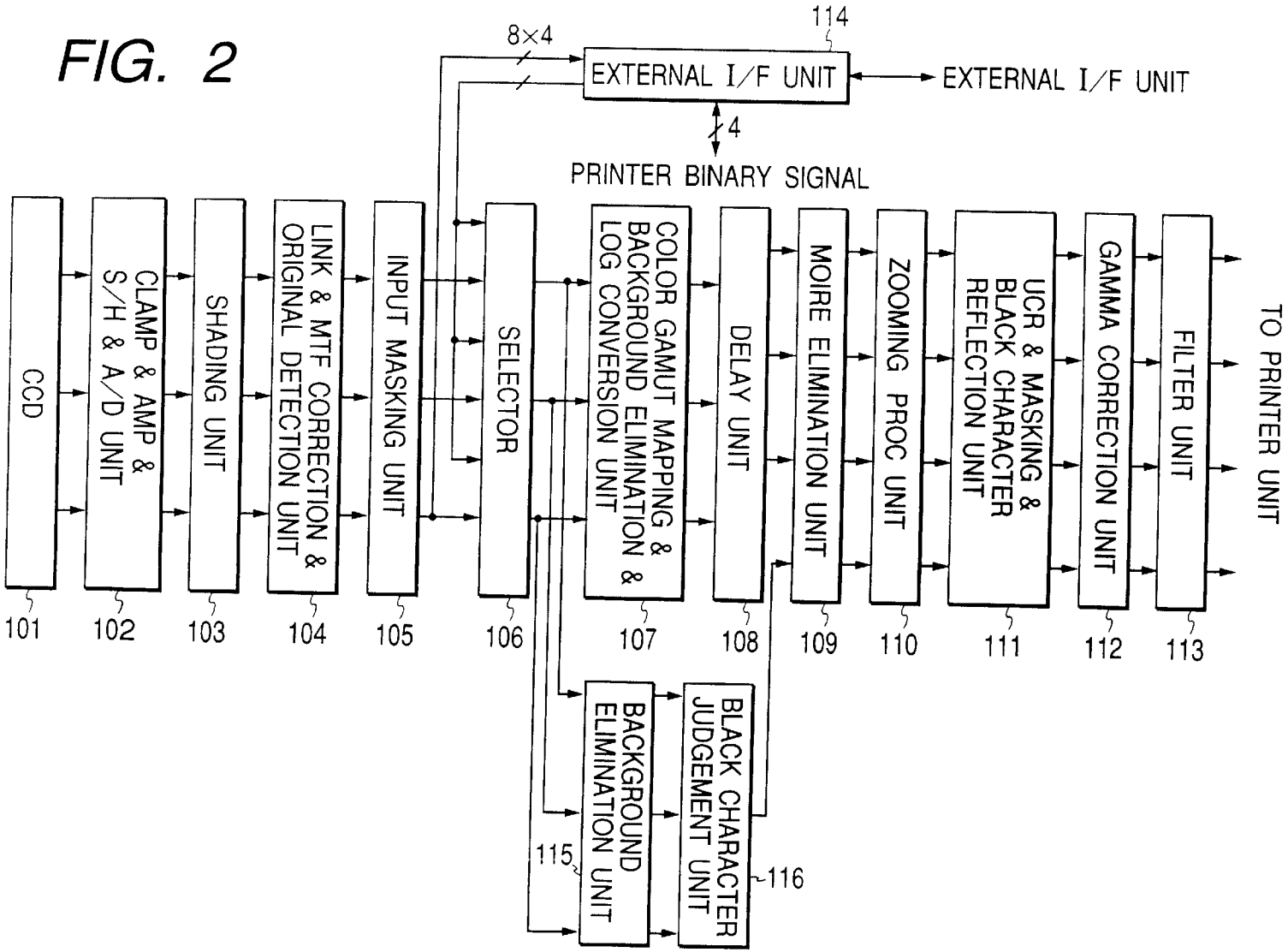
FIG. 2 is a block diagram showing a detailed structure of a digital image process unit 312 in the first embodiment.

FIG. 2 is a block diagram showing a detailed structure of the digital image process unit 312.

The lights from the light sources 303 and 304 are reflected by the original put on the original mounting glass 301, and the reflected lights are converted into electrical signals in a photoelectric conversion operation by the CCD 101. If it causes the CCD 101 to act as a color sensor, a one-line CCD or a three-line CCD may be used as the sensor. In the one-line CCD, R (red), G (green) and B (blue) color filters are arranged in that order in an in-line manner. On the other hand, in the three-line CCD, each of the R, G and B color filters is arranged on each of three lines. Further, the color filters may be integrated with the CCD in an on-chip manner, or may be independent of the CCD itself.

Electrical signals (i.e., analog image signal) output from the CCD 101 are input to the image process unit 312 and further input to a clamp and amplification and S/H (sample and hold) and A/D (analog-to-digital conversion) unit 102. In the unit 102, each analog image signal is subjected to a S/H process, and a dark level of each signal is clamped at a reference potential and then amplified to a predetermined level. It should be noted that the order of S/H, clamp and amplification processes is not limited to the above order.

The processed signals are A/D converted into, e.g., R, G and B eight-bit digital signals. Then, the converted R, G and B signals are subjected to shading correction and black correction by a shading unit 103. The corrected signals are further subjected to a link (or joining) process, an MTF (modulation transfer function) process and an original detection process by a link and MTF correction and original detection unit 104.

In the case where the CCD 101 is the three-line CCD, a reading position of each line is different from others. Therefore, the link process is performed to adjust a delay quantity of each line according to reading speed and then correct signal timing such that the reading positions of the three lines become identical. The original detection process is performed to confirm an original size by scanning the original on the glass 301. The digital signals of which reading position timing has been corrected are then input to an input masking unit 105. In the unit 105, a spectral characteristic of the CCD 101 and spectral characteristics of the light sources 303 and 304 and the reflectors 305 and 306 are corrected.

Outputs of the input masking unit 105 are then input to a selector 106 capable of switching the output signals of the unit 105 to/from an external interface signal. Output signals from the selector 106 are input to a color gamut mapping (or color space compression) and background elimination (or substratum elimination) and LOG (logarithmic) conversion unit 107 and also to a background elimination unit 115. The signals input to the unit 115 are subjected to background elimination and then input to a black character judgement unit 116. The unit 116 judges whether or not the signals represent a black character in the original, and generates a black character signal based on the original.

In the unit 107 to which the outputs of the selector 106 are input, a color gamut mapping process, a background elimination process and LOG conversion are performed on the input signals. In the color gamut mapping process, it is judged whether or not the read image signal is within a range reproducible by a printer. If judged that the signal is not within the range, such the signal is corrected to be within that range. Then, the signal is subjected to the background elimination process, and the processed R, G and B signals are LOG converted into C (cyan), M (magenta) and Y (yellow) signals. Thereafter, timing of the signals output from the unit 107 is adjusted by a delay unit 108 such that these signals are in synchronism with the signal generated by the black character judgement unit 116.

These two kinds of signals are subjected to moire elimination by a moire elimination unit 109, and further subjected to a zooming process in the main-scan direction by a zooming process u nit 110. Numeral 111 denotes an UCR (under color removal) and masking and black character reflection unit. In the unit 111, the C, M and Y signals processed by the unit 110 are subjected to an UCR process to generate the C, M, Y and K (black) signals. These signals are subjected to a masking process to suit them to a printer output operation, and the judgement signal generated by the black character judgement unit 116 is fed back to the C, M, Y and K signals. The signals processed by the unit 111 are density-adjusted by a gamma correction unit 112, and then subjected to a smoothing or edge process by a filter unit 113.

Figure 3:
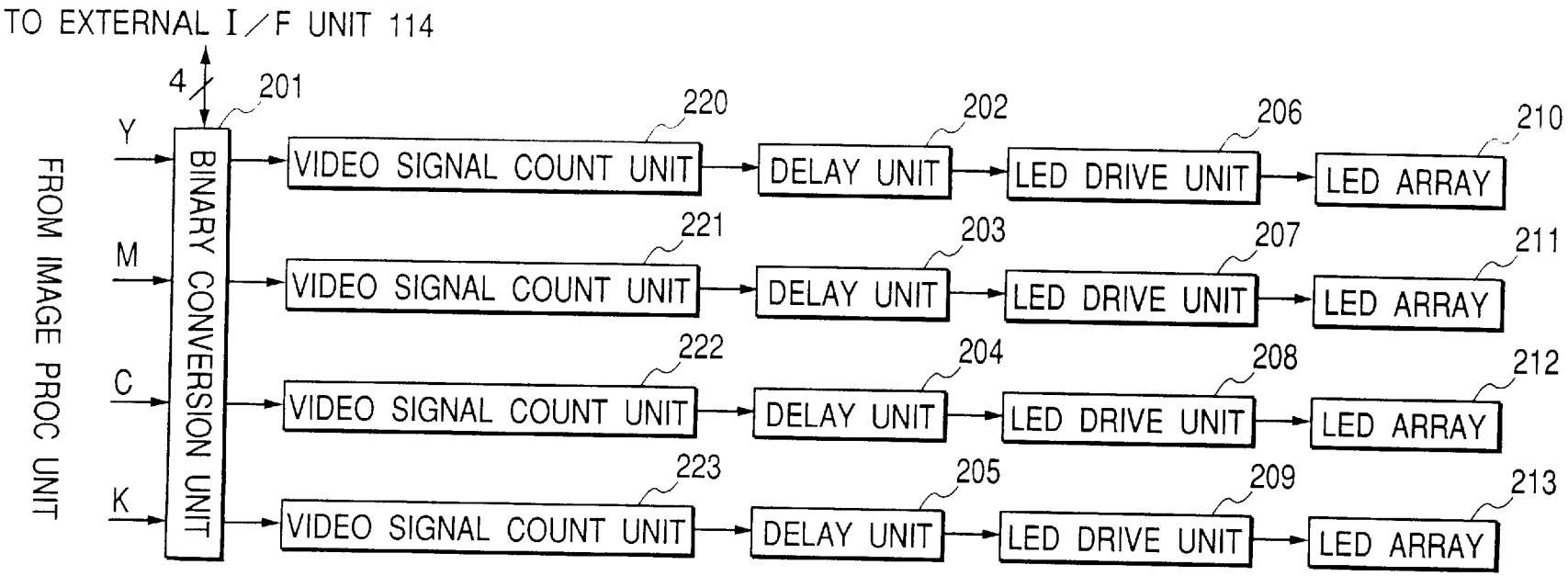
FIG. 3 is a block diagram showing a structure of an LED drive unit in the first embodiment.

The eight-bit (multivalue) signals processed as above are converted into binary signals by the binary conversion unit 201 shown in FIG. 3. In this case, a dither method, an error diffusion method or an improved error diffusion method may be used to convert the multivalue signal.

Subsequently, a structure of the color printer unit 200 will be explained.

In FIG. 1, numeral 317 denotes a Y image formation unit, numeral 318 denotes an M image formation unit, numeral 319 denotes a C image formation unit, and numeral 320 denotes a K image formation unit. Since structures of the units 317 to 320 are identical, only the structure of the unit 317 will be explained in detail. Thus, explanations of the other units are omitted.

In the Y image formation unit 317, numeral 342 denotes a photosensitive drum. A latent image is formed on a surface of the drum 342 by light from an LED (light emitting diode) array 210. Numeral 321 denotes a charger for charging at predetermined potential the surface of the drum 342 which rotates at speed 150 mm/sec, to prepare the latent image formation. Numeral 322 denotes a development unit for developing the latent image on the drum 342 to form a visualized toner image.

The development unit 322 contains a sleeve 365 for applying development bias. Numeral 323 denotes a transfer charger for charging the drum 342 from a position behind a transfer belt 333 to transfer the toner image on the drum 342 onto a recording paper sheet or the like on the belt 333. Then, a residual toner on the drum 342 is once adsorbed by the charger 321, an electrostatic characteristic of the adsorbed toner is changed, and then the toner is returned onto the drum 342. Thus, the development unit 322 again utilizes the returned toner.

Subsequently, a procedure to form an image on the recording paper sheet or the like will be explained.

The sheets held in a cassette 340 or 341 are picked up one by one by a pickup roller 338 or 339, and the picked-up sheet is supplied onto the transfer belt 333 by paper feed rollers 336 and 337. At this time, the belt 333 is moving at speed 150 mm/sec. The supplied sheet is charged by an adsorption charger 346. Numeral 348 denotes a transfer belt roller for driving the transfer belt 333. Further, a pair of the charger 346 and the roller 348 charges the sheet, whereby the sheet is adsorbed to the belt 333.

Numeral 347 denotes a paper leading edge sensor for detecting a leading edge of the sheet on the belt 333. A detection signal from the sensor 347 is sent from the color printer unit 200 to the color reader unit 100, and used as a sub-scan sync signal when a video signal is sent from the reader unit 100 to the printer unit 200.

After then, the sheet is carried by the transfer belt 333, and Y, M, C and K toner images are formed in that order on a surface of the sheet respectively by the image formation units 317 to 320.

The sheet passed the K image formation unit 320 is discharged by a discharge charger 349 such that the sheet can be easily separated from the belt 333. Then, the discharged sheet is actually separated from the belt 333. Numeral 350 denotes a separation charger for preventing image confusion because of separation discharge at a time when the sheet is separated from the belt 333. The separated sheet is charged by prefixing chargers 351 and 352 such that adsorptive force of the toner is compensated to prevent the image confusion. Then, the toner image is heat-fixed to the sheet by a fixing unit 334, and the sheet is discharged (or ejected) to a paper discharge tray 335. Further, the transfer belt 333 is discharged by inside and outside dischargers 353.

Subsequently, image recording by the LEDs of the color printer unit 200 will be explained.

In FIG. 3, the signals from the image process unit are binarized by the binarization conversion unit 201, and the binarized signals are sent to video signal count units 220 to 223 respectively corresponding to Y, M, C and K images. Each of the units 220 to 223 can count the total number of light emission elements of corresponding one of LED arrays 210 to 213. Then, the binarized image signals are delayed by the respective delay units 202 to 205 according to respective distances between the sensor 347 and respective image formation positions, and then sent to respective LED drive units 206 to 209. The units 206 to 209 generate signals to drive the respective LED arrays 210 to 213.

Subsequently, a density control method of the present invention to be performed in the development unit will be explained.

In the present invention, Y, M, C and K color toners are used.

A color image faithful to the original is formed by distribution of these four-color toners. Thus, in order to stably form a full-color image at any time, it is necessary to maintain a constant toner density for each color toner in the development unit.

Figure 4:
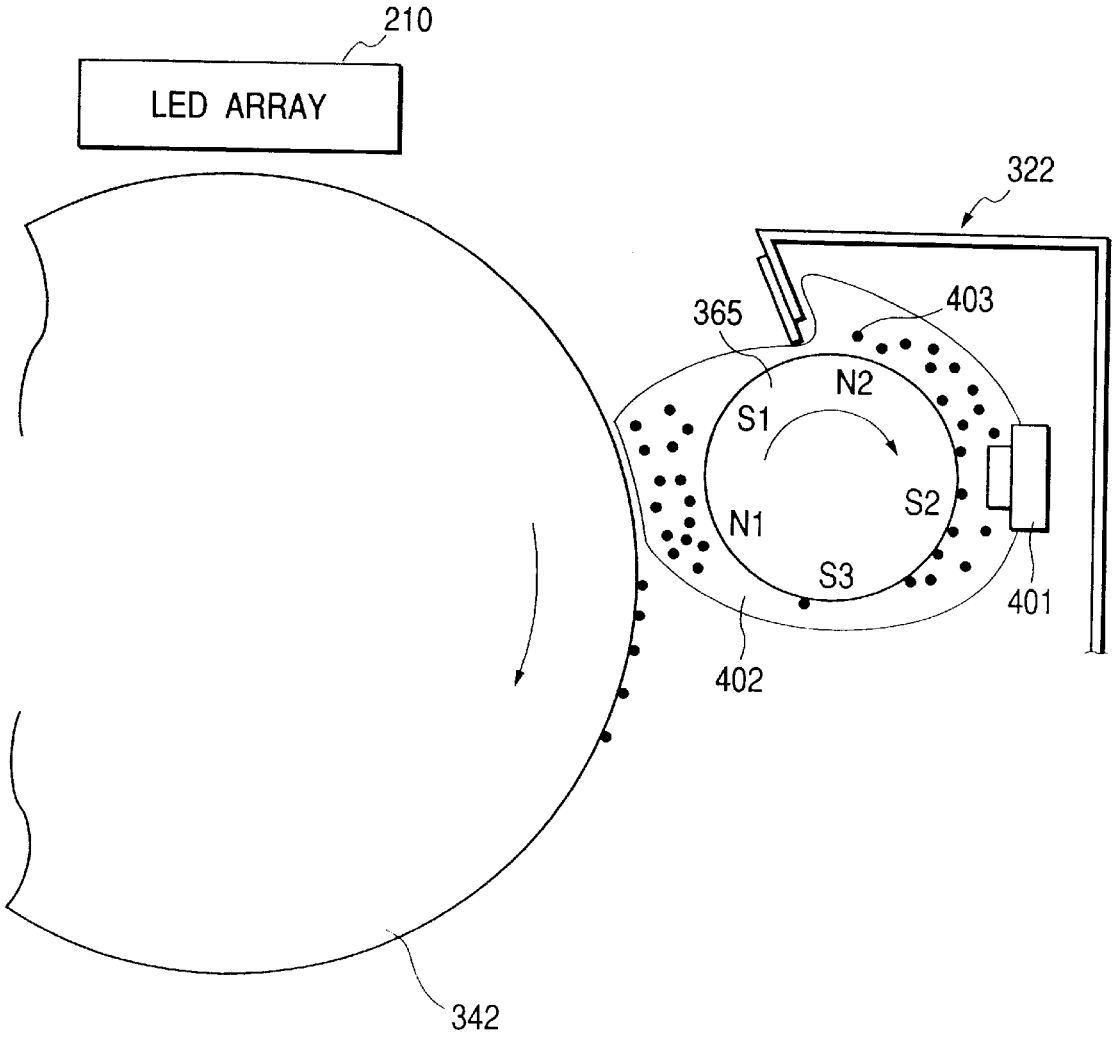
FIG. 4 is a schematic sectional view showing a structure of a development unit of an yellow station in the first embodiment.

The development unit of an yellow station according to the first embodiment is shown in FIG. 4.

In the embodiment, a development agent is composed of a non-magnetic toner 403 and a carrier 402 including magnetic substances. Magnetic permeability of the development agent is determined based on a quantity of the carrier occupying certain volume (or content). Thus, in the embodiment, a sensor 401 for measuring the magnetic permeability of the development agent is provided to detect a change in a ratio of the toner to the development agent on the basis of a change of apparent magnetic permeability of the development agent in certain volume nearby a sensor surface (i.e., on the basis of a percentage of the carrier in the development agent in certain volume), and to supply the toner according to the detected change, thereby stabilizing the toner density.

When the development agent is forwarded from a factory as a product, the ratio of the toner to the carrier has been arranged to satisfy a predetermined ratio. However, since the sensor 401, bundled lines in the body and the like have individual differences respectively, adjustment is necessary. For this reason, a value measured by the sensor in the development unit when the development agent is forwarded from the factory is previously stored as a reference value, and then the toner of which quantity corresponds to a difference between the value measured by the sensor and the reference value is replenished while the image formation is being performed, thereby maintaining the constant toner density.

Subsequently, an image formation station unit in the first embodiment will be explained.

In the embodiment, since each of the Y image formation unit 317, the M image formation unit 318, the C image formation unit 319 and the K image formation unit 320 has a cartridge form, the image formation unit is appropriately referred as a cartridge unit hereinafter.

Figure 5:
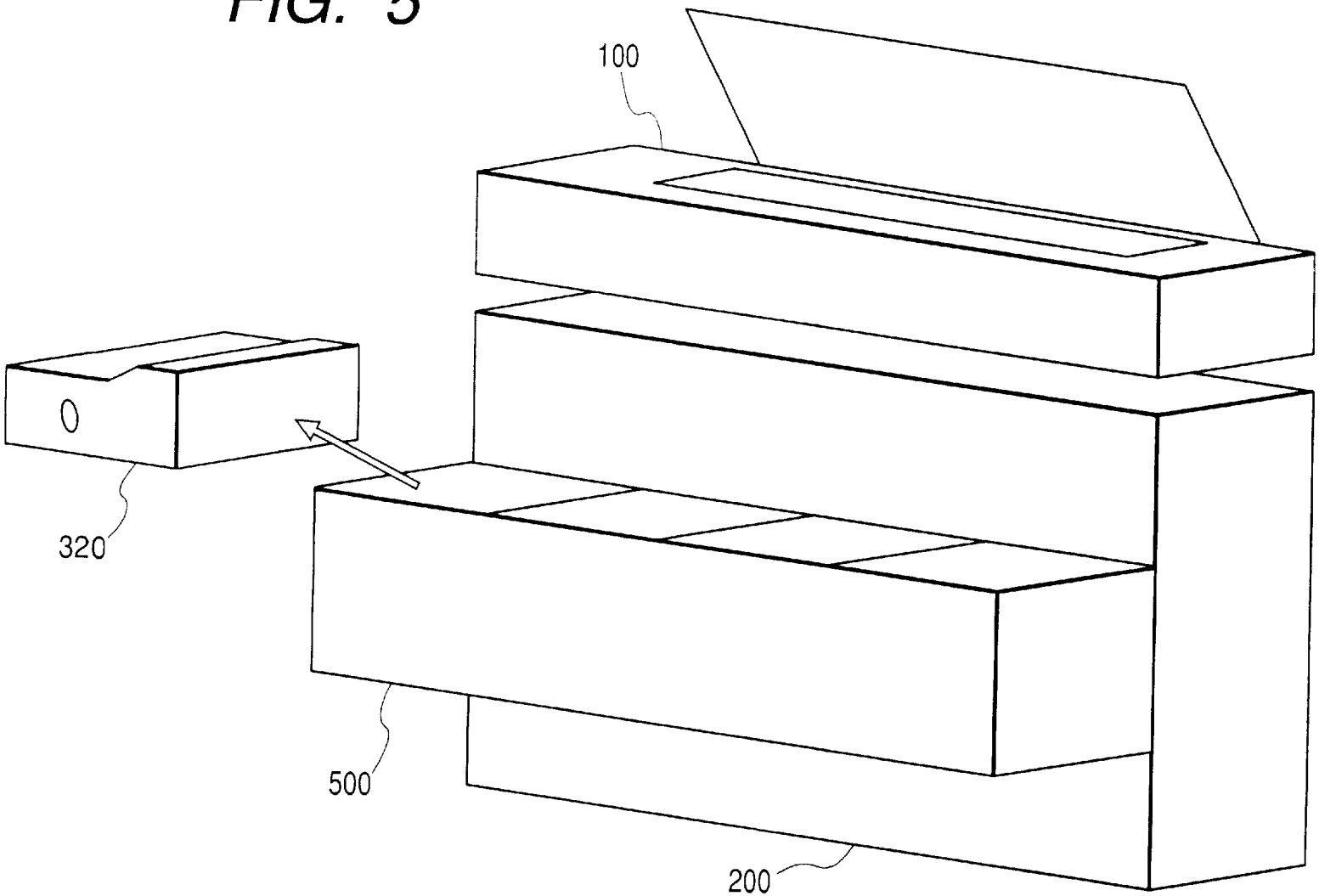
FIG. 5 is a perspective view showing a structure of an image station cartridge in the first embodiment.

As shown in FIG. 5, the image formation station unit has a structure in which an image formation station storage unit 500 can be pulled out frontward, and each cartridge unit is detachable from the unit 500. In the drawing, the cartridge unit 320 of the black station is picked up.

Figure 6:
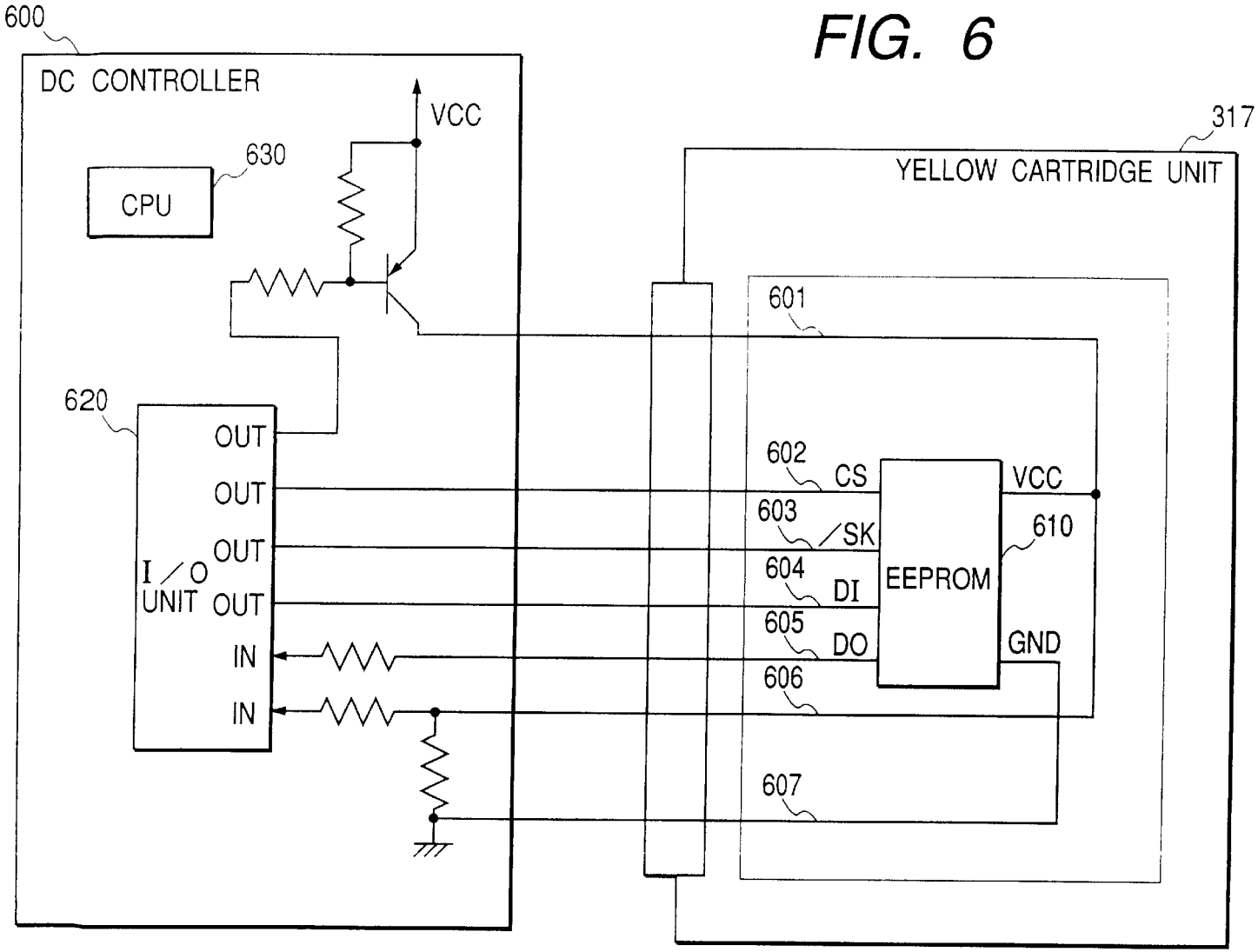
FIG. 6 is a circuit diagram showing an electrical connection of a cartridge unit in the first embodiment.

FIG. 6 shows an electrical connection of the cartridge unit, e.g., the Y cartridge unit 317, in the first embodiment. As shown in the drawing, the unit 317 is connected to the body of the image formation apparatus by means of seven lines.

Numeral 601 denotes a power supply line, numeral 607 denotes a ground (GND) line, and numerals 602 to 606 denote signal lines. Serial signal transfer between an I/O (input/output) unit 620 of the body and an EEPROM (electrically erasable programmable read-only memory) 610 acting as a data storage means in the unit 317 is performed through the signal lines 602 to 606. Concretely, a select signal CS, an EEPROM clock signal /SK and an output signal DI are input to the EEPROM 610 respectively through the signal lines 602, 603 and 604.

On the other hand, a signal DO from the EEPROM 610 and a cartridge connection signal (power supply voltage VCC) from the unit 317 are input to the I/O unit 620 respectively through the signal lines 605 and 606. In response to the cartridge connection signal, it can be detected whether or not the Y cartridge unit 317 has been mounted in the body of the image formation apparatus.

The EEPROM clock signal /SK is sent from an output port of the I/O unit 620, and the signals DI and DO are read or written in synchronism with the signal /SK. Thus, these signals can be written/read to/from a memory address within the EEPROM 610.

Later-described body discrimination information and density control data have been stored in the EEPROM 610. Also, the body discrimination information has been stored in a nonvolatile memory provided in the body of the image formation apparatus.

Figure 7:
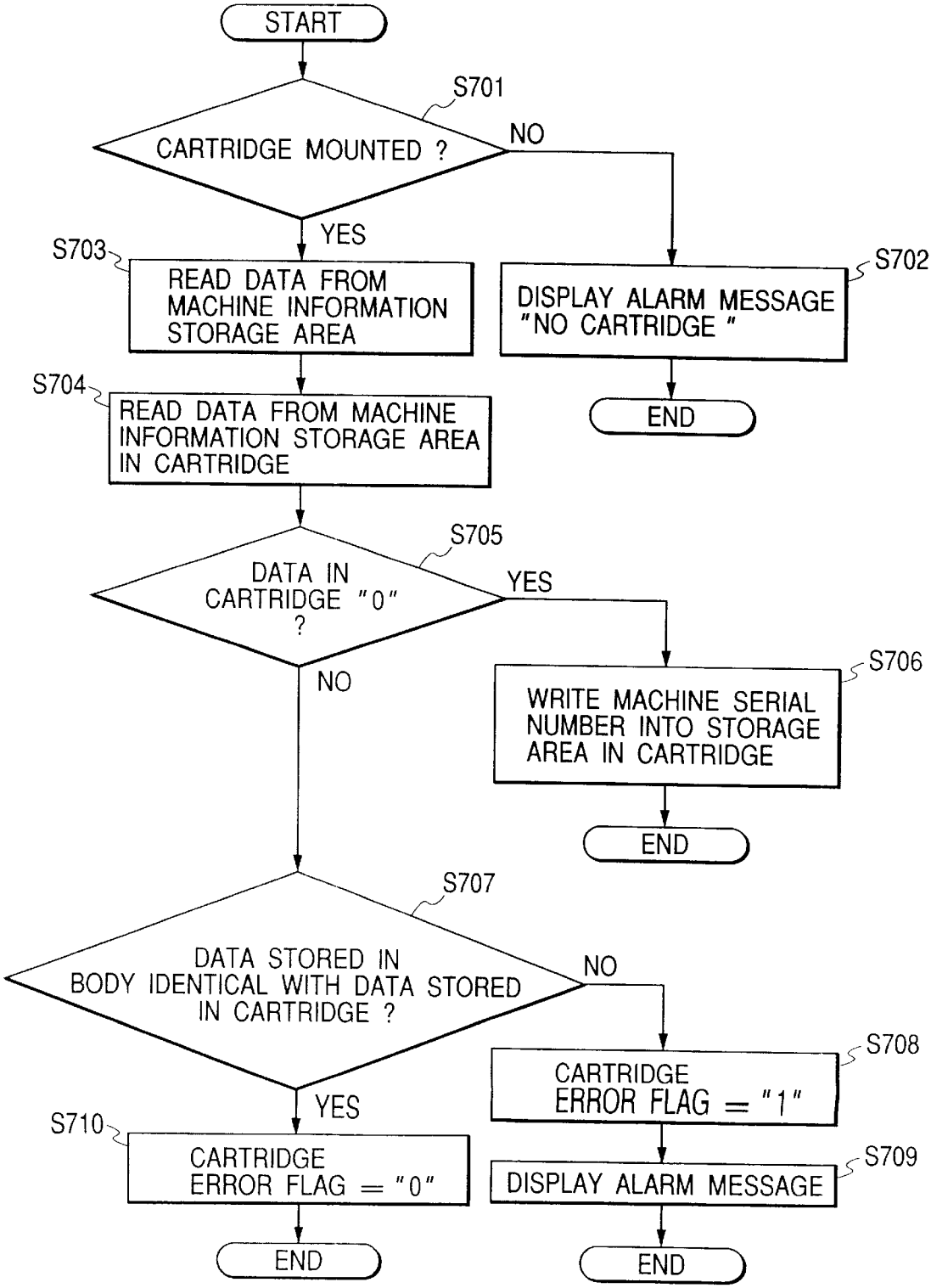
FIG. 7 is a flow chart showing an example of algorithm to issue an alarm message when an another cartridge is mounted in the color image process apparatus in the first embodiment.

Subsequently, an example of a process in a case where a cartridge of the other apparatus is erroneously mounted will be explained with reference to a flow chart shown in FIG. 7. It should be noted that this process is the substance of the present invention.

When power is ON, it is judged by a CPU 630 of the body of the image formation apparatus whether or not the cartridge unit is being mounted in the body (step S701). If judged that the cartridge is not mounted, then a message to urge a user to mount the cartridge is displayed on a display panel of an operation unit (step S702). On the other hand, if judged in the step S701 that the cartridge is being mounted, serial number data of the body previously stored in a machine information storage area of the body is read out (step S703). Concretely, such the serial number data has been stored in a memory such as a ROM or the like capable of holding stored information even if the power is OFF.

Subsequently, data stored in the EEPROM 610 of the mounted cartridge unit (sometimes simply referred as "cartridge" hereinafter) is read out (step S704), and it is judged whether or not the read data represents "0" (step S705). If judged that the data represents "0", it means that the cartridge has never been used after it was forwarded from the factory. Namely, this cartridge was first mounted in this body. Therefore, the serial number data read in the step S704 is written into a body information storage area in the EEPROM 610 of the body (step S706), and a check operation terminates. In the step S704, the data may be read out of the body information storage area. That is, if the cartridge which has never been used is being mounted, any body information is not yet stored therein, and thus the read data represents "0".

On the other hand, if judged in the step S705 that the data read out of the EEPROM 610 of the cartridge does not represent "0", then the serial number data (i.e., discrimination information of apparatus body) read in the step S703 is compared with serial number data (i.e., discrimination information of body) read out of the EEPROM 610 of the cartridge (step S707). If the data is not coincident, it means that the cartridge of the other apparatus is being erroneously mounted. Therefore, a cartridge error flag representing that the cartridge is being erroneously mounted is set into "1" (step S708), and then an alarm message is displayed (step S709).

On the other hand, if the data is coincident in the step S707, it means that the genuine cartridge is being correctly mounted in the body. Thus, the cartridge error flag is cleared into "0" in a step S710, and it is displayed on the operation unit of the body that the apparatus is ready for copy.

In a case where the cartridge which has never been used is mounted, a measurement process is performed for density control. Then, the density control data obtained in this process is stored in the EEPROM 610 of the cartridge and/or the memory of the body.

Figure 8A:
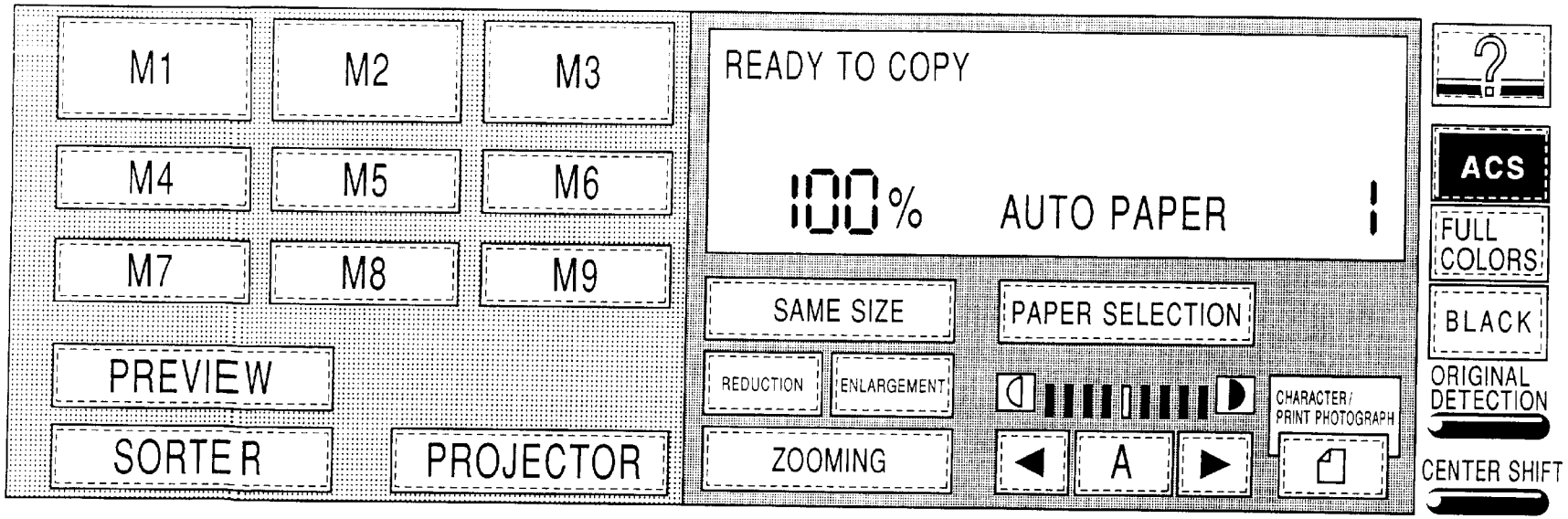
FIGS. 8A and 8B are explanation views showing displaying examples of an operation unit in the first embodiment.
Figure 8B:
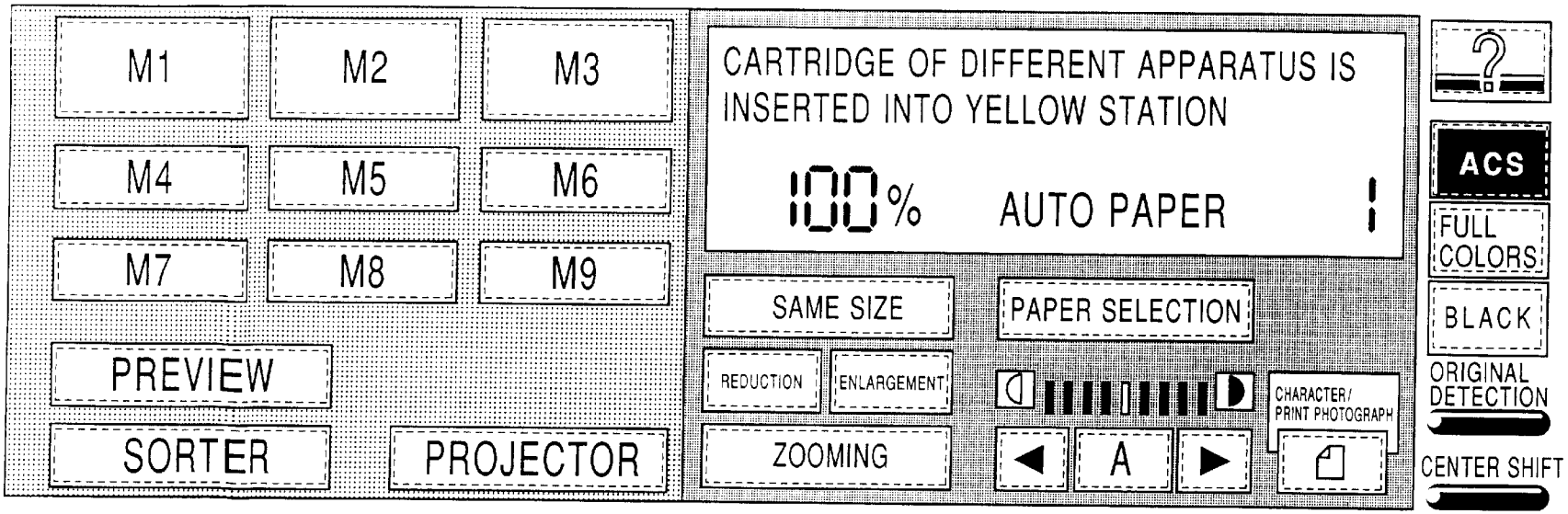

FIGS. 8A and 8B show displaying examples of the operation unit in the present invention.

FIG. 8A shows a state of the step S710 in which, since the genuine or correct cartridge is being mounted, a copy sequence can be executed.

FIG. 8B shows a state of the step S709 in which, since the cartridge of the other apparatus is being erroneously mounted in the yellow station by the user, the alarm message is being displayed.

Figure 9:
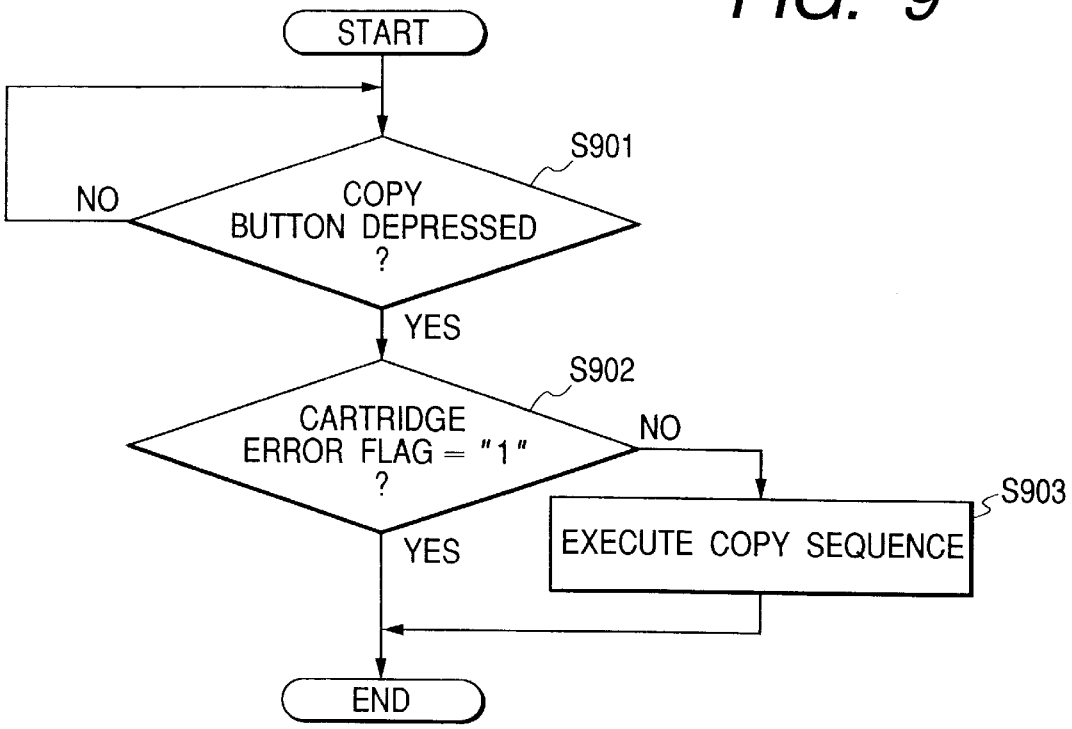
FIG. 9 is a flow chart showing algorithm at a time when a copy sequence starts in the first embodiment.

FIG. 9 is a flow chart showing algorithm at a time when the copy sequence starts in the first embodiment. That is, permission or prohibition of a copy operation is determined according to the process shown in this flow chart.

In a step S901, it is always judged by the CPU 630 of the body whether or not a copy button is depressed. Such a judgement process is repeated until the button is depressed. If the button is depressed, then it is judged in a step S902 whether or not the cartridge error flag explained in FIG. 7 is "1". If judged that the flag is "0", since any error does not occur, the flow advances to a step S903 to execute the ordinary copy sequence. On the other hand, if judged in the step S902 that the flag is "1", since an error occurs in the cartridge mounting, the process stops without executing the copy sequence. For this reason, optical scanning by the CCD 101 and subsequent image process sequences are not executed.

According to the first embodiment, it becomes possible to prohibit the copy operation including image reading in the case where the cartridge is erroneously mounted. Therefore, it can be prevented that the color reproducibility of the image is deteriorated and the apparatus becomes out of order because the apparatus is operated with the incorrect cartridge being mounted and thus the density target value changes.

Hereinafter, the meaning of the body serial number used as the information to discriminate the body will be supplemented. In the color image formation apparatus, in order to prevent or suppress forgery of bank notes and variable papers, a pattern which has been converted based on the body serial number and can not be perceived by human eyes is formed in the image output through the image formation operation. By such an operation, when a forgery is found, the apparatus used in the forgery copy can be specified or discriminated based on the formed pattern. However, since such a forgery prevention technique does not directly relate to the substance of the present invention, detailed explanation thereof is omitted.

The example that the cartridge is erroneously mounted in the yellow station (i.e., yellow cartridge unit) has been described above. However, the present invention is not limited to this. That is, the present invention can be applied to the other stations of the color copy machine, in the similar manner as above.

(Second Embodiment)

In the first embodiment, the copy sequence was explained as the example of the copy machine operation. However, the present invention is not specifically limited to the copy machine operation. That is, the same operation as above is performed even in a case where an image transferred from a computer is print output by the image formation apparatus, and also in a case where the image is print output by the color printer unit 200 of the copy machine.

For example, image data supplied from a host computer is converted into Y, M, C and K data by an image expansion controller (not shown), and received as the input image through an external I/F (interface) unit 114 shown in FIG. 2. Then, the same image formation process as that explained in the above copy machine operation is performed, and the obtained image is print output on a recording medium. In this case, the image expansion controller communicates with the CPU 630 through the external I/F unit 114, whereby information in the body, a print output start instruction from the image expansion controller, and the like are managed therebetween.

Figure 10:
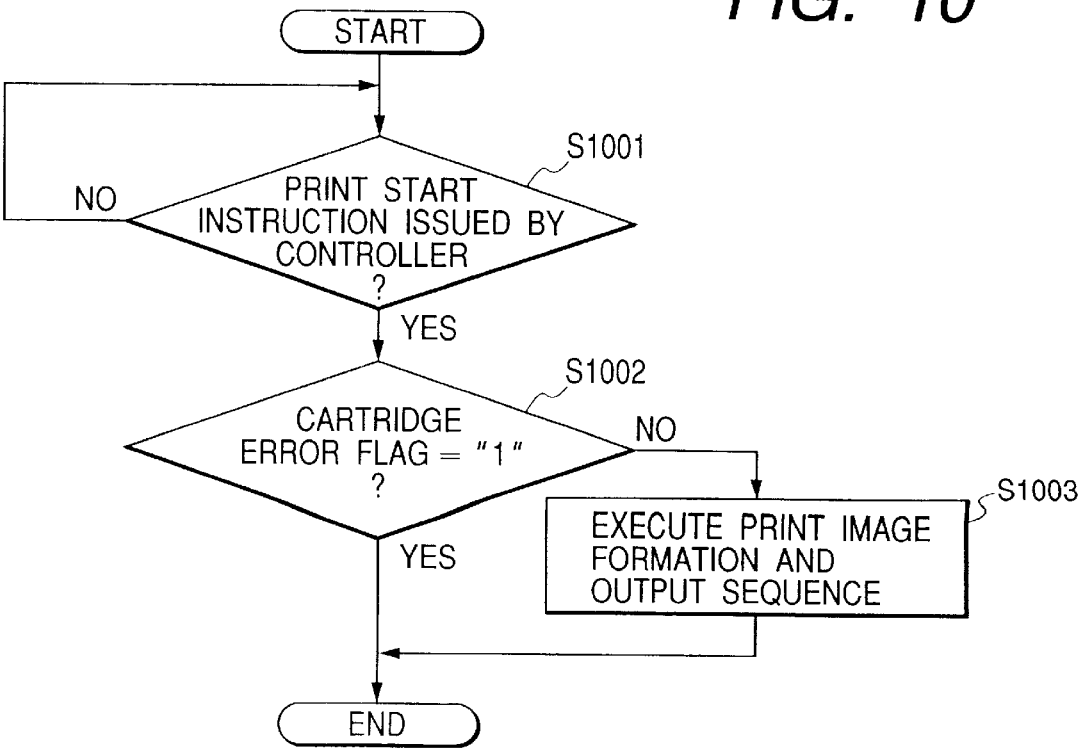
FIG. 10 is a flow chart showing algorithm at a time when a print sequence starts in a second embodiment of the present invention.

FIG. 10 is a flow chart showing the operation at a time of print output in the second embodiment. That is, permission or prohibition of the print output operation is determined according to the process shown in this flow chart.

In a step S1001, it is always judged by the CPU 630 of the body whether or not a print start instruction is issued by the image expansion controller. Such a judgement process in the step S1001 is repeated until the print start instruction is issued. If the instruction is issued, then it is judged in a step S1002 whether or not the cartridge error flag explained in FIG. 7 is "1". If judged that the flag is "0", since any error does not occur, the flow advances to a step S1003 to execute an ordinary print image formation and output sequence.

On the other hand, if judged in the step S1002 that the flag is "1", since an error occurs in the cartridge mounting, the process stops without executing the print image formation and output sequence. For this reason, scanning onto the photosensitive drums 342 to 345 and subsequent image formation sequences in an electrophotographic process are not executed.

According to the second embodiment, it becomes possible to prohibit the print image formation and output in the case where the cartridge is erroneously mounted. Therefore, it can be prevented that color reproducibility of the image is deteriorated and the apparatus becomes out of order because the apparatus is operated with the incorrect cartridge being mounted and thus a density target value changes.

In the above-described embodiments, the body discrimination information is stored in the EEPROM of the cartridge. However, discrimination information of the cartridge may be conversely stored in the nonvolatile memory of the body.

Further, in the above-described embodiments, when the cartridge used in the other apparatus is erroneously mounted, the alarm is given. However, even in a case where the cartridge of one image formation station is erroneously mounted in the other image formation station within the identical apparatus, the present invention is also applicable. In this case, color discrimination information has been stored together with the body discrimination information in the memory of the cartridge, and comparison is performed. That is, if at least one of the two kinds of information is not coincident, the image formation is prohibited and the alarm is given.

The present invention is not limited to the above-described embodiments and is subjected to various modifications within the scope of the appended claims.

What is claimed is:

1. An image forming apparatus comprising:

mounting means for mounting a cartridge including a memory, the memory having a predetermined area;

reading means for reading data from the memory of the cartridge mounted by said mounting means; and first discriminating means for discriminating that the data of the predetermined area of the memory read by said reading means is discriminating information specifying said image forming apparatus.

2. An apparatus according to claim 1, further comprising second discriminating means for discriminating that the data of the predetermined area of the memory read by said reading means is the data specifying neither said image forming apparatus nor another image forming apparatus.

3. An apparatus according to claim 1, further comprising control means for controlling, when discriminating information specifying another image forming apparatus has been stored in the predetermined area of the memory of the cartridge newly mounted, said image forming apparatus to perform at least one of displaying of such a fact and inhibiting of an image forming operation.

4. An apparatus according to claim 1, further comprising means for performing, when the data specifying neither said image forming apparatus nor another image forming apparatus has been stored in the predetermined area of the memory of the cartridge at least newly mounted, a measuring process for density control.

5. An apparatus according to claim 4, wherein said image forming apparatus includes plural image forming stations each of which has a mounting part to which the cartridge is mounted and which form images of mutually different colors, and the memory has an area in which information specifying the station to which the cartridge should be mounted is stored.

6. An image forming apparatus, comprising:

mounting means for mounting a cartridge including a memory; and writing means for writing data in the memory of the cartridge mounted by said mounting means, wherein said writing means can write discriminating information specifying said image forming apparatus in a predetermined area of the memory, so that, even after the cartridge was released, said image forming apparatus can be specified as the image forming apparatus which had mounted the cartridge before on the basis of the discriminating information written in the predetermined area.

7. An apparatus according to claim 6, further comprising:

reading means for reading the data from the memory of the cartridge mounted by said mounting means; and discriminating means for discriminating that the data in the predetermined area of the memory read by said reading means is the data specifying neither said image forming apparatus nor another image forming apparatus.

8. An apparatus according to claim 6, further comprising control means for controlling, when discriminating information specifying another image forming apparatus has been stored in the predetermined area of the memory of the cartridge newly mounted, said image forming apparatus to perform at least one of the displaying of such a fact and inhibiting of an image forming operation.

9. An apparatus according to claim 6, further comprising:

means for performing a measuring process for density control; and control means for controlling, when the data specifying neither said image forming apparatus nor another image forming apparatus has been stored in the predetermined area of the memory of the cartridge newly mounted, said image forming apparatus to perform at least one of a process to write the discriminating information specifying said image forming apparatus in the predetermined area and the measuring process.

10. An apparatus according to claim 6, wherein said image forming apparatus includes plural image forming stations each of which has a mounting part to which the cartridge is mounted and which form images of mutually different colors, and the memory has an area in which information specifying the station to which the cartridge should be mounted is stored.

11. An image forming apparatus comprising:

mounting means for mounting a cartridge including a memory, the memory having a first area which is rewritten by the image forming apparatus when the cartridge is first mounted, and a second area in which data used to control density of an image to be formed is stored;

reading means for reading the data from the memory of the cartridge mounted by said mounting means;

writing means for writing data in the memory of the cartridge mounted by said mounting means;

discriminating means for discriminating, when the cartridge is newly mounted, whether or not the newly mounted cartridge is a new cartridge on the basis of the data in the first area of the memory; and means for performing, when it is discriminated at least by said discriminating means that the newly mounted cartridge is the new cartridge, a measuring process for density control, wherein, when it is discriminated by said discriminating means that the newly mounted cartridge is the new cartridge, said writing means transcribes the data in the first area of the memory into another data area of the memory and also writes the data obtained by the measuring process in the second area of the memory.

12. An apparatus according to claim 11, further comprising original reading means for reading an original image.

13. An apparatus according to claim 12, further comprising converting means for converting first-type image data output from an external device into second-type image data used for image forming.

14. An apparatus according to claim 11, wherein said image forming apparatus includes plural image forming stations each of which has a mounting part to which the cartridge is mounted and which form images of mutually different colors, and the memory has a third area in which information specifying the station to which the cartridge should be mounted is stored.

15. An apparatus according to claim 14, further comprising control means for controlling, when the image forming station represented in the third area of the memory of the newly mounted cartridge does not coincide with the image forming station of the mounted mounting part, said apparatus to perform at least one of displaying of such a fact and inhibiting of an image forming operation.

16. A controlling method in an image forming apparatus, comprising:

a reading step of reading, when a cartridge including a memory is mounted to the image forming apparatus, data from the memory of the mounted cartridge; and a first discriminating step of discriminating, when the data of a predetermined area of the memory is read in said reading step, that the read data of the predetermined area of the memory is discriminating information specifying the image forming apparatus itself.

17. A method according to claim 16, further comprising a second discriminating step of discriminating that the data of the predetermined area of the memory read in said reading step is the data specifying neither the image forming apparatus nor another image forming apparatus.

18. A method according to claim 16, further comprising a control step of controlling, when discriminating information specifying another image forming apparatus has been stored in the predetermined area of the memory of the cartridge newly mounted, the image forming apparatus to perform at least one of displaying of such a fact and inhibiting of an image forming operation.

19. A method according to claim 16, further comprising a step of performing, when the data specifying neither the image forming apparatus nor another image forming apparatus has been stored in the predetermined area of the memory of the cartridge at least newly mounted, a measuring process for density control.

20. A method according to claim 19, wherein the image forming apparatus includes plural image forming stations each of which has a mounting part to which the cartridge is mounted and which form images of mutually different colors, and the memory has an area in which information specifying the station to which the cartridge should be mounted is stored.

21. A controlling method in an image forming apparatus, comprising:

a holding step of holding discriminating information specifying the image forming apparatus; and a writing step of writing, when a cartridge including a memory is mounted to the image forming apparatus, data in the memory of the mounted cartridge, wherein said writing step can write discriminating information specifying the image forming apparatus in a predetermined area of the memory, so that, even after the cartridge was released, the image forming apparatus can be specified as the image forming apparatus which has mounted the cartridge before on the basis of the discriminating information written in the predetermined area.

22. A method according to claim 21, further comprising:

a reading step of reading the data from the memory of the cartridge mounted to the image forming apparatus; and a discriminating step of discriminating that the data in the predetermined area of the memory read in said reading step is the data specifying neither the image forming apparatus nor another image forming apparatus.

23. A method according to claim 22, further comprising a control step of controlling, when discriminating information specifying another image forming apparatus has been stored in the predetermined area of the memory of the cartridge newly mounted, the image forming apparatus to perform at least one of displaying of such a fact and inhibiting of an image forming operation.

24. A method according to claim 22, further comprising:

a step of performing a measuring process for density control; and a control step of controlling, when the data specifying neither the image forming apparatus nor another image forming apparatus has been stored in the predetermined area of the memory of the cartridge newly mounted, the image forming apparatus to perform at least one of a process to write the discriminating information specifying the image forming apparatus in the predetermined area and the measuring process.

25. A method according to claim 21, wherein the image forming apparatus includes plural image forming stations each of which has a mounting part to which the cartridge is mounted and which form images of mutually different colors, and the memory has an area in which information specifying the station to which the cartridge should be amounted is stored.

26. A controlling method in an image forming apparatus, comprising:

a reading step of reading, when a cartridge including a memory having a first area which is rewritten by the image forming apparatus when the cartridge is first mounted and a second area in which data used to control density of an image to be formed is stored is mounted to the image forming apparatus, data from the memory of the mounted cartridge;

a writing step of writing data in the memory of the mounted cartridge;

a discriminating step of discriminating, when the cartridge is newly mounted, whether or not the newly mounted cartridge is a new cartridge on the basis of the data in the first area of the memory; and a step of performing, when it is discriminated at least in said discriminating step that the newly mounted cartridge is the new cartridge, a measuring process for density control, wherein, when it is discriminated in said discriminating step that the newly mounted cartridge is the new cartridge, said writing step transcribes the data in the first area of the memory into another data area of the memory and also writes the data obtained by the measuring process in the second area of the memory.

27. A method according to claim 26, further comprising an original reading step of reading an original image.

28. A method according to claim 27, further comprising a converting step of converting first-type image data output from an external device into second-type image data used for image forming.

29. A method according to claim 26, wherein the image forming apparatus includes plural image forming stations each of which has a mounting part to which the cartridge is mounted and which form images of mutually different colors, and the memory has a third area in which information specifying the station to which the cartridge should be mounted is stored.

30. A method according to claim 29, further comprising a control step of controlling, when the image forming station represented in the third area of the memory of the newly mounted cartridge does not coincide with the image forming station of the mounted mounting part, the apparatus to perform at least one of displaying of such a fact and inhibiting of an image forming operation.

31. A cartridge which is mounted to an image forming apparatus, comprising:

a process unit used for image forming; and a memory having an area in which discriminating information specifying the image forming apparatus to which said cartridge should be mounted is written.

32. A cartridge according to claim 31, wherein the memory has an area in which data used for a density control operation of the image forming apparatus to which said cartridge has been mounted is stored.

33. A cartridge according to claim 31, wherein said cartridge can be mounted to the image forming apparatus which includes plural image forming stations each of which has a mounting part to which said cartridge is mounted and which form images of mutually different colors, and the memory has an area in which information specifying the station to which said cartridge should be mounted is stored.

34. A cartridge which is mounted to an image forming apparatus, comprising:

a process unit used for image forming; and a memory having a predetermined area in which discriminating information specifying the image forming apparatus to which said cartridge has been mounted is written by this image forming apparatus, so that, even after said cartridge was released, the image forming apparatus to which said cartridge had been mounted before can be specified on the basis of the discriminating information written in the predetermined area.

35. A cartridge according to claim 34, wherein the memory has an area in which data used for a density control operation of the image forming apparatus to which said cartridge has been mounted is stored.

36. A cartridge according to claim 34, wherein said cartridge can be mounted to the image forming apparatus which includes plural image forming stations each of which has a mounting part to which said cartridge is mounted and which form images of mutually different colors, and the memory has an area in which information specifying the station to which said cartridge should be mounted is stored.

37. A cartridge which is mounted to an image forming apparatus, comprising:

a process unit used for image forming; and a memory, wherein said memory has a first area which can store information which is written by the image forming apparatus to which said cartridge is first mounted, so that, when said cartridge is mounted to the image forming apparatus, it is possible to discriminate whether or not said newly mounted cartridge is a new cartridge on the basis of the data in the first area of said memory, and wherein said memory has a second area which can store data obtained by performing a predetermined measuring process with the image forming apparatus to which said cartridge is first mounted.

38. A cartridge according to claim 37, wherein said cartridge can be mounted to the image forming apparatus which includes plural image forming stations each of which has a mounting part to which said cartridge is mounted and which form images of mutually different colors, and said memory has a third area in which information specifying the station to which said cartridge should be mounted is stored.

* * * * *